US008943638B1

(12) United States Patent
Armaly, Jr.

(10) Patent No.: US 8,943,638 B1
(45) Date of Patent: Feb. 3, 2015

(54) FLOOR MOP

(71) Applicant: Armaly Sponge Company, Walled Lake, MI (US)

(72) Inventor: John W. Armaly, Jr., Grosse Pointe, MI (US)

(73) Assignee: Armaly Sponge Company, Walled Lake, MI (US)

( * ) Notice: Subject to any disclaimer, the term of this patent is extended or adjusted under 35 U.S.C. 154(b) by 0 days.

(21) Appl. No.: 14/041,958

(22) Filed: Sep. 30, 2013

(51) Int. Cl.
*A47L 13/146* (2006.01)
*A47L 13/60* (2006.01)
*A47L 13/258* (2006.01)

(52) U.S. Cl.
CPC ..... *A47L 13/60* (2013.01); *A47L 13/258* (2013.01)
USPC ..... 15/119.2

(58) Field of Classification Search
CPC ..... A47L 13/14; A47L 13/146
USPC ..... 15/116.2, 119.2
See application file for complete search history.

(56) References Cited

U.S. PATENT DOCUMENTS 2,730,744 A * 1/1956 Vaugha ..... 15/119.2
2,892,201 A * 6/1959 Peterson et al. ..... 15/119.2
3,224,025 A * 12/1965 Altrock ..... 15/119.2
4,044,419 A * 8/1977 Robinson ..... 15/119.2
5,896,613 A 4/1999 Courtney et al.
RE36,635 E 4/2000 Vosbikian et al.
6,418,585 B1 7/2002 Viner
6,550,094 B1 4/2003 Hurtado
6,675,426 B2 * 1/2004 Ohm et al. ..... 15/119.2
6,716,805 B1 4/2004 Sherry et al.
6,785,927 B2 9/2004 Lesley et al.
6,854,150 B2 2/2005 Hirse
7,178,189 B1 2/2007 Perry et al.
7,260,865 B2 8/2007 Lesley et al.
7,263,739 B2 9/2007 Boyer et al.
7,540,056 B2 6/2009 Dotterman et al.
7,640,616 B2 1/2010 Peterson
2006/0137121 A1 * 6/2006 Niccolai ..... 15/119.2
2008/0168612 A1 * 7/2008 Lee et al. ..... 15/119.2

* cited by examiner

*Primary Examiner* — Mark Spisich
(74) *Attorney, Agent, or Firm* — Bill C. Panagos; Linda D. Kennedy; Butzel Long, PC

(57) ABSTRACT

A floor mop composed of a handle portion, a wringer assembly portion and a mop portion. The handle is equipped with a wringer assembly that slideable moves along the length of the handle a predetermined distance. The wringer assembly has a guide that cooperatively engages the handle to limit travel of the wringer assembly. The wringer assembly has wringer arms that terminate in wringer engagement guide to engage wringer guides on the centerplates of the butterfly floor mop. Each arm further include a cam surface proximal to the wringer engagement guides that cooperative engage linearly inclined ramps to apply progressive pressure on an absorbent material to wring wash liquid during wash operations.

12 Claims, 4 Drawing Sheets

FLOOR MOP

TECHNICAL FIELD

Butterfly mops, i.e., those having a handle attached to a center carrier piece with carrier plates connected thereto, have long been known in the art. While well received by the consumers, there remain certain shortcomings in design. For example, during the wringing process, it has been a challenge to exert uniformly progressive pressure from one end of the carrier plate to the other so that the wash liquid is progressively wrung from the mop. There are many mop wringing devices currently in use, but the results have not been entirely satisfactory. While it is possible for the operator to exert ever greater physical force to the mop during the wringing process to obtain the desired result, eventually the operator will avoid using the mop because of the difficulties involved or will cease to apply the prerequisite physical force during mop wringing, thereby contributing to less than desired cleaning results.

In addition, the wringer apparatus must not interfere with free operation of the mop after the wringing process is completed. The mop head must be freely rotatable to permit the greatest freedom of movement and operation. As such, the wringer should not be in contact either of the carrier plates during the mopping operation. Moreover, carrier plates must not be bias able beyond substantially perpendicular to the mop handle so that adequate pressure can be exerted to the mop and the carrier plates will exert the right pressure to the surface to the cleaned.

These and other objects may be achieved according to the present disclosure. In one embodiment, a mop handle having a length greater than its width is equipped with a wringer assembly that slideably moves a predetermined distance along the length of the handle. The wringer assembly has opposed wringer arms, each of which is equipped with a wringer assembly guide. At the ends of the arms are wringer engagement guides. Each arm is further equipped with a cam surface, such as a convex surface, proximal to the wringer engagement guide, intermediate from the end of the wringer arm and the attachment of the wringer arm to the wringer arm assembly body.

Attached at one end of the handle by a universal joint is a carrier center piece. The center carrier piece has biased hinges along its sides by which two carrier plates are attached. The center carrier plate has stops to halt biasing of the hinges beyond substantially perpendicular to the length of the handle portion when the wringer assembly is not in contact with carrier plates.

Each carrier plate has a wringer guide assembly along its top surface to engage the wringer assembly guides to stop the center carrier plate from rotating when the wringer assembly contacts the carrier plate. The wringer assembly guide may be spaced apart walls which are more widely spaced apart at the proximal end of the carrier plate, than at the distal end of the carrier plate. In between the wringer guide assembly walls is a progressively inclined surface to interact with the cam surface on the wringer arm to ensure progressive, uniform pressure is applied to the center plates as the wringer assembly is moved along the handle toward the center plates. The inclined surface may be to parallel walls with that progressively incline from the proximal end of the center plate toward the distal end of the centerplate.

The centerplates further have a bottom surface with attachments that permit the detachable attachment of absorbent material to it to permit mopping and cleaning of surfaces. In one embodiment, the absorbent material is Estracell®, available from the Armaly company in Walled Lake, Mich.

Other advantages and developments of the present disclosure are explained in the following drawings and description. Those skilled in the art recognize that the following description is not limiting, but rather merely illustrative of the many variations possible.

SUMMARY

In one embodiment, the disclosure is directed to a floor mop. The mop may have a handle portion having a length and a width, with the length greater than the width. The handle portion has a first end and a second end. A wringer assembly is slideably carried along at least a portion of said handle portion length and is adapted to travel a predetermined distance along the length of the handle portion. The wringer assembly has a body portion which may be equipped with two opposing wringer arms. Each wringer arm is joined to the wringer body at a first end and equipped with a carrier plate engagement guide at a second end. Each wringer arm may be further equipped with a cam surface proximate to carrier plate engagement guide intermediate the first and second wringer assembly ends.

A carrier center piece is attached to the handle portion second end by a universal hinge. The carrier center piece has a body with opposing first and second sides. Each of the center piece body first and second sides may be equipped with biased hinges and stop plates. The mop further includes at least two carrier plates having a length and a width. Each carrier plate has a top surface and a bottom surface and may be equipped with hinges for hingeable attachment to the center carrier plate hinges and biasable substantially perpendicular to the handle portion length. Each carrier plate may further be equipped along the top surface with a wringer arm engagement guide extending substantially along the length of the carrier plate from a proximal end to a distal end. The wringer engagement guide may be configured to interact with a wringer arm engagement guide. Each wringer engagement guide may further be equipped with a cam surface engagement incline. Each cam surface engagement incline extends from the distal end of each carrier plate in a declining slope along the carrier plate length to a position intermediate the distal end and the proximal end. Each carrier plate may further be equipped with plate stops interactive with the wringer arms to limit travel of the wringer assembly along the wringer guide assembly.

DETAILED DESCRIPTION

Figure 1:
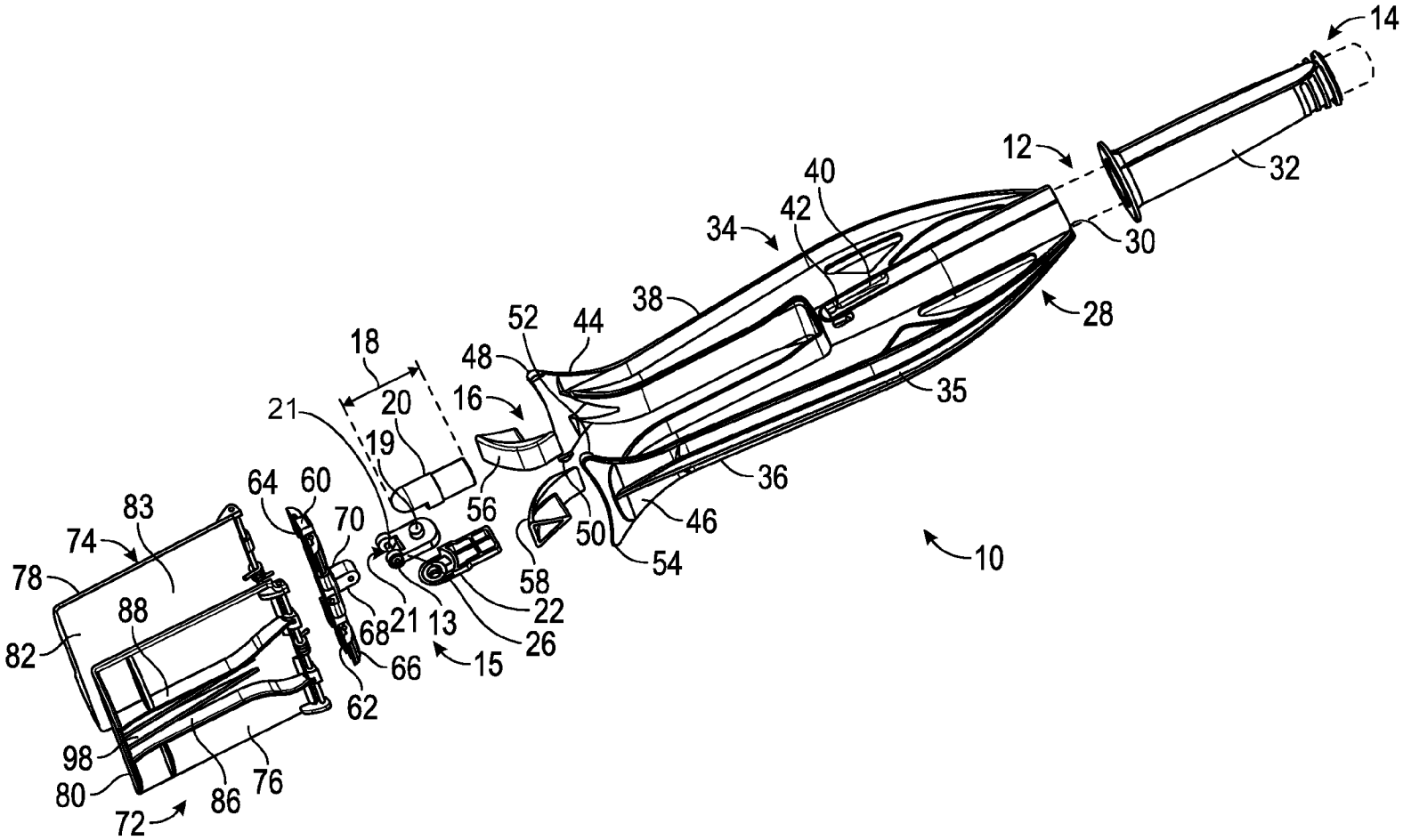
FIG. 1 is a side perspective exploded view of one embodiment of the floor mop
Figure 2:
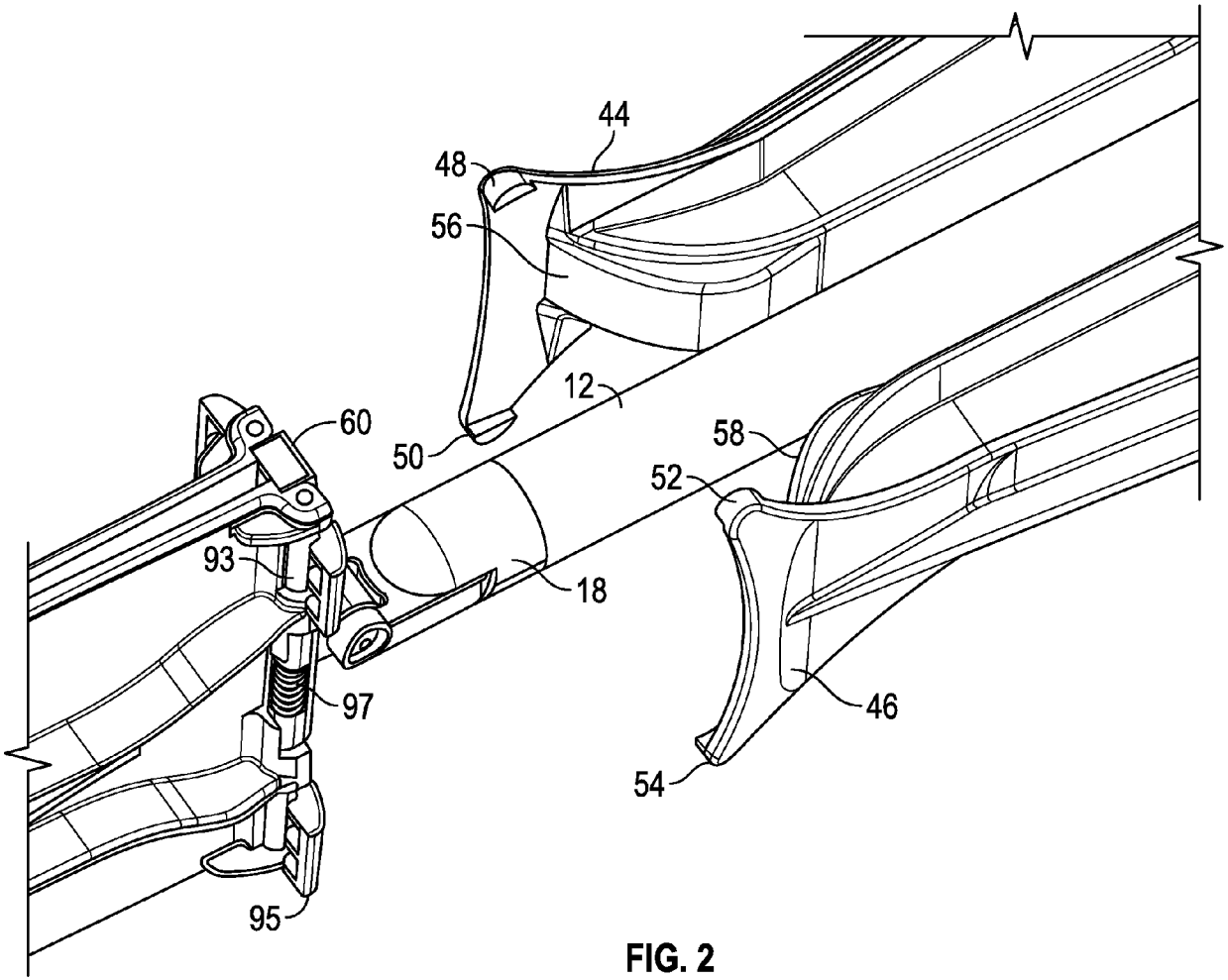
FIG. 2 is a close up side perspective view of a section of the floor mop of FIG. 1.
Figure 4:
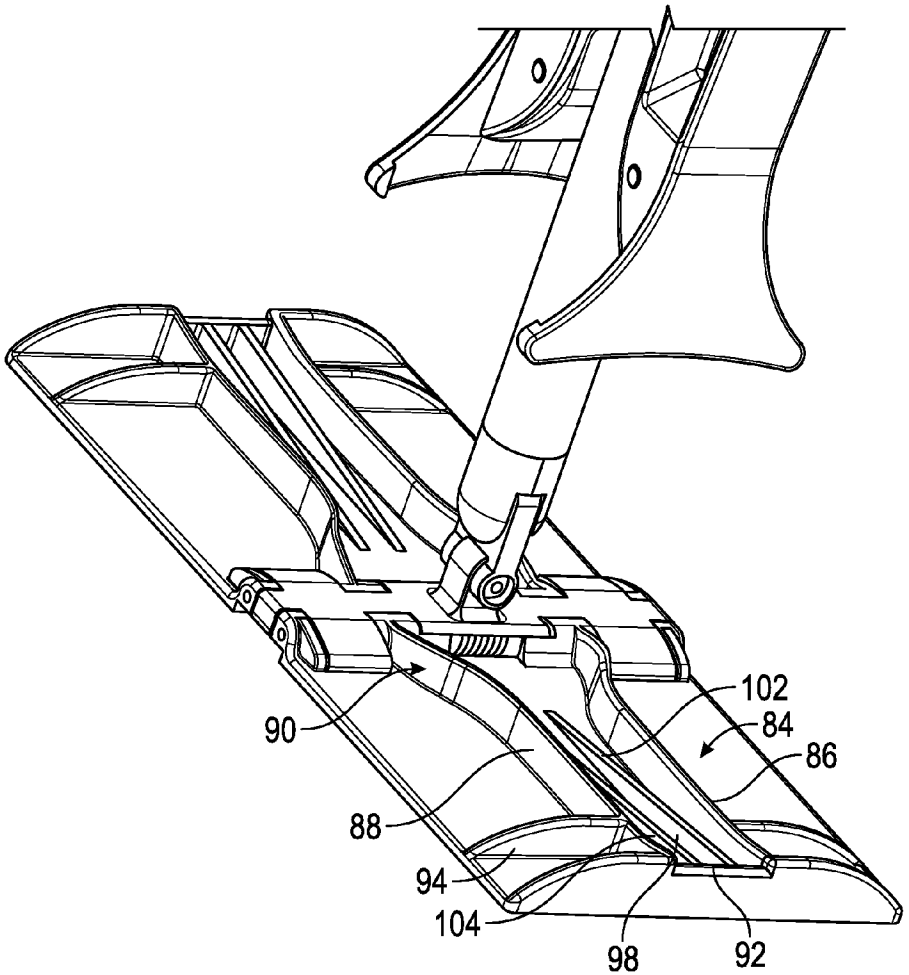
FIG. 4 is a sectional perspective view of the floor mop showing the construction of the Wringer guide assembly of one embodiment of the present disclosure
Figure 3:
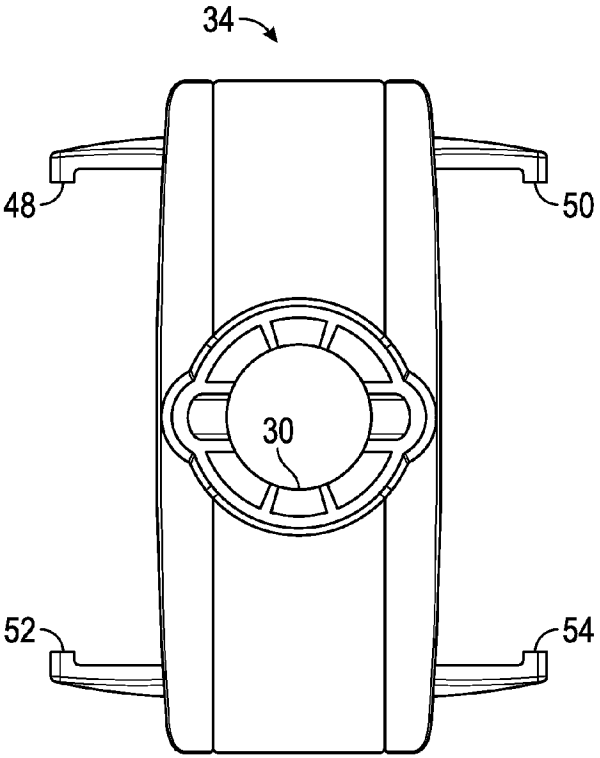
FIG. 3 is a sectional view of the wringer assembly of one embodiment of the present disclosure.

Turning now to the drawings, wherein like numbers refer to like structures, and particularly to FIGS. 1-3, floor mop 10 is shown having handle portion 12, which has a first end 14 and opposed second end 16. The handle can be understood as having a length and a width, with the length being greater than its width. As shown the handle is a cylindrical pole, but any shaped handle may be used, it being understood that the length should be greater than the width of the handle.

End 16 is equipped with a universal joint, shown as a cardan joint 18. As is understood, cover plates 20 and 22 are fixedly attachable to the handle end 16, and house pivot piece 26. The pivot piece has a pivot 19 to permit movement around its axis, and rotating pin 21 carried in U joint 15 to permit rotation about its axis 13.

A wringer slide assembly 28 is slideably carried by the handle. Specifically, in this embodiment, the wringer slide assembly has an aperture 30 that extend the length of the slide assembly and through with the handle portion may slide. A guide, such as slot slide 40 interactive with pin 42 carried on the handle, is provided along the length of the wringer slide assembly body to limit the travel of the wringer slide assembly along the length of the handle portion.

The wringer assembly has a hand grip portion 32 at one end and opposite to the handgrip portion is a wringer slide assembly body 34. Wringer arms 36 and 38 are attached to, or integral with, the wringer slide assembly body at one end and extend a distance along the length of the handle portion in spaced apart opposition to each other. Each of the wringer arms may be reinforced with a ridge 35 extending substantially the length of the wringer arm. Each wringer arm terminates in carrier plate engagement guides 44 and 46, respectively. The guides may be fan shaped, as depicted here, or may be of any shape to suite the particular construction of the mop center plates as will be hereinafter described. As depicted here, each carrier plate engagement guide may be equipped with extension guides 48 and 50 and 52 and 54, respectively to engage the carrier plates as will be hereinafter described.

Intermediate the wringer assembly body and the carrier plate engagement guide, and preferably proximal to the carrier plate engagement guide, cam surfaces 56 and 58 are provided on the wringer arms, respectively. As shown, the cammed surfaces are depicted in an exploded view. In final assembly, these cammed surfaces may be snap fitted into place in the receiving ends of the wringer arms as shown. In another embodiment, the cammed surfaces may be integrally formed in the wringer arms. The cam surfaces may a simple or compound convex configuration, or of any other configuration as to present a cam surface.

A carrier center piece 60 has a carrier piece body 66 and is equipped with a centrally located flange 68. Flange 68 has an aperture 70, adapted to receive rotating pin 21 in the U joint of the cardan joint, so that when the mop is assembled, the carrier center piece is pivotally attached to the cardan joint. The carrier center piece has a body is equipped with biased hinges on opposite sides and stops 95 to limit biasing of the carrier plates beyond substantially perpendicular to the handle portion when the wringer arms are not in engagement with the carrier plates.

Pivotally attached to the carrier piece are carrier plates 72 and 74, respectively. Each carrier plate has a length and a width. Each carrier plate has a proximal end and a distal end. Each plate is pivotally attached at its proximal end to the biased hinge 93 of the carrier center piece. Although the biaser is shown as a coil spring 97, it is understood that any biaser could be used, including other springs, elastic or resilient materials. The carrier plates have a top side 76, 78, respectively, and a bottom side 80 and 82, respectively. The bottom side may have attachments 83, such as hooks and loop fasteners, such as Velcro, or any other attachment suitable for detachable attachment of an absorbent material suitable for mopping and cleaning operations. Any suitable woven, non woven, natural sponge, polyethylene polypropylene sponge material or cellulosic material as in known in the art may be used, and in particular, Estercell from Armaly is particularly useful.

Figure 5:
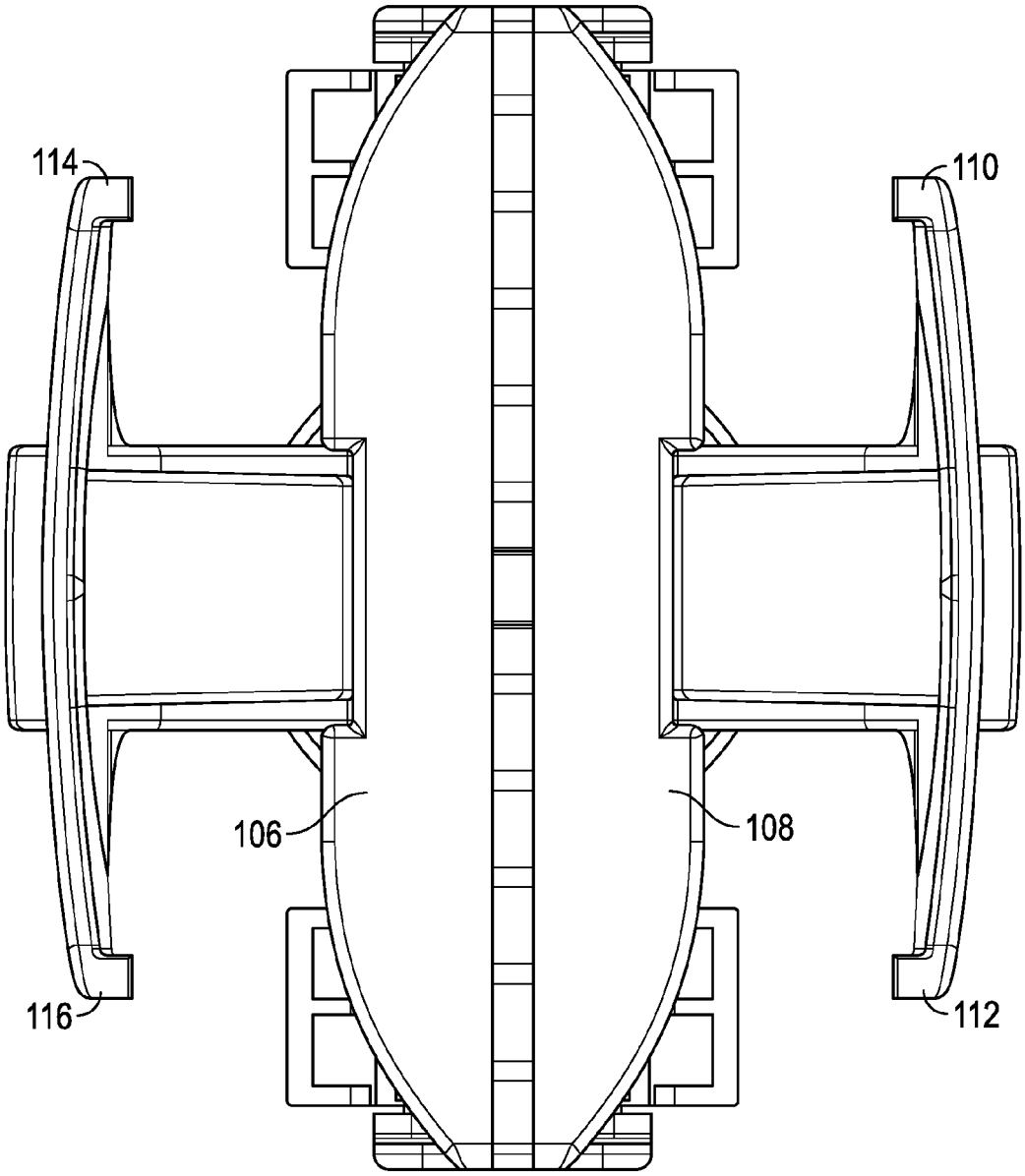
FIG. 5 is an end view of the floor mop showing the position of the carrier plates when the wringer assembly is in storage.

Top surface of each carrier plate is equipped with a wringer arm guide engagement 84, consisting in one embodiment by opposed guides 86 and 88. The opposed guides are shown as wall structures spaced apart a determined distance and extend from the proximal end 90 of the carrier plate to the distal end. The guides may be spaced apart a greater distance at the proximal end than at the distal end of the carrier plate. The carrier plate top further includes cam ramp 98, shown as two opposed walls (102, 104) with linear incline from the proximal end to the distal end of each carrier plate. As shown herein, in at least one embodiment, the incline cam ramp extends from the distal end to a point intermediate the proximal end of the carrier plate. It should also be noted that each ramp declines at a linear slope from the distal end toward the proximal end of each carrier plate. The ramp structure may further consist of two wall surfaces of the proper linear incline as outlines above. Each carrier plate further may be equipped with an intermediate cam stop, defined between stiffening members 94 and 92. In operation, when the wringer guide assembly is actuated along the handle portion, the carrier plate engagement guides come into contact with the corresponding wringer arm guide engagement on the carrier plate, eliminate rotation about the cardan joint, and move the carrier plates together in a butterfly motion so that the bottom surfaces of each carrier pate are moved into facing engagement with each other. During this butterfly motion, the cam surface on each arm engages the inclined ramp surface and progressively and uniformly applies pressure on the absorbent material to squeeze liquid from the proximal end of the carrier plate to the distal end. As seen in FIG. 5, when the wringer assembly is fully engaged with the carrier plates, the carrier plates assume the configuration depicted therein, and the wash liquid is squeezed from the absorbent material. When the wringer assembly is disengaged from the carrier pates, the mop assumes the configuration as shown in FIG. 2, and the user is ready to resume cleaning operation.

FIG. 5 is an end view of the improved floor mop showing the mop in a closed position. The carrier pates are equipped at their ends with generally planar surfaces 106, 108 respectively. These surfaces together with the generally planar ends 110, 112, 114 and 116, respectively of the extension guides act cooperatively as a stable platform so that the mop may be stored in a closed position mop end down.

The words used to explain the embodiments disclosed are understood to be descriptive, and not limiting. While several embodiments have been described, those skilled in the art readily understand that many variations and modifications are possible without departing from the scope and spirit of the invention as set forth in the appended claims.

The invention claimed is:

1. A floor mop, comprising:

a handle portion having a length and a width, said length greater than said width;

said handle portion having a first end and a second end;

a wringer assembly slideably carried along at least a portion of said handle portion length; said wringer assembly adapted to travel a predetermined distance along the length of the handle portion; said wringer assembly having a body portion; said body portion equipped with two opposing wringer arms; each wringer arm joined to said wringer body at a first end and equipped with a carrier plate engagement guide at a second end; each said wringer arm further equipped with a cam surface proximate to carrier plate engagement guide intermediate the first and second wringer arm ends;

a carrier center piece attached to the handle portion second end by a universal hinge; said carrier center piece having a body with opposing first and second sides; each of the carrier center piece body first and second sides being equipped with biased hinges and stop plates; and at least two carrier plates having a length and a width; each said carrier plate having a top surface and a bottom surface; each said carrier plate being hingeably attached to said center carrier and biasable substantially perpendicular to said handle portion length; each said carrier plate equipped along said top surface with a wringer arm engagement guide extending substantially along the length of the carrier plate from a proximal end to a distal end; each said wringer arm engagement guide configured to interact with a corresponding carrier plate engagement guide; each wringer arm engagement guide further equipped with a cam surface engagement incline; each said cam surface engagement incline extending from said distal end of each carrier plate in a declining slope along the carrier plate length to a position intermediate the distal end and the proximal end.

2. The floor mop of claim 1, further including attachments on the bottom surface of each carrier plate adapted to detachably attach an absorbent material suitable for cleaning a surface.

3. The floor mop of claim 1, wherein said wringer assembly includes a slot along a portion of the wringer assembly body portion substantially parallel to said handle portion length; said slot interactive with a guide pin carried by said handle portion.

4. The floor mop of claim 1, further including a hand grip portion to facilitate travel of the wringer assembly.

5. The floor mop of claim 1, wherein each carrier plate engagement guide is integral with a corresponding wringer arm and is equipped with extension guides to interact with a respective wringer arm engagement guide on each of said carrier plates.

6. The floor mop of claim 1, wherein the universal hinge is a cardan joint.

7. The floor mop of claim 1, wherein the hingeably attached carrier plates are attached to the center carrier piece with a spring-biased hinge.

8. The floor mop of claim 1, wherein the wringer arm engagement guide is comprised of walls separated by a distance and engageable with said carrier plate engagement guide to prevent rotation of the carrier plates about the universal hinge during mop wringing.

9. The floor mop of claim 8, wherein the distance between the walls of the wringer arm engagement guide is greater at the proximal end of the carrier plate than the distal end of the carrier plate.

10. The floor mop of claim 1, wherein the cam surface engagement incline includes at least two parallel incline walls.

11. The floor mop of claim 1, further including a ridge extending along the length of each wringer arm.

12. The floor mop of claim 1, further including a planar surface on the ends of the carrier plates, and the planar surfaces are engageable with extension guides on a corresponding wringer arm to form a generally planar storage surface when the mop is closed.

* * * * *